US005180473A

United States Patent [19]

Akune et al.

[11] Patent Number: 5,180,473

[45] Date of Patent: Jan. 19, 1993

[54] PAPER-MAKING PROCESS

[75] Inventors: Kenichi Akune; Naotaka Watanabe; Yukihiro Inomiya, all of Tokyo; Hiroshi Itoda, Kanagawa; Takeo Arai, Kanagawa; Reiko Funato, Kanagawa, all of Japan

[73] Assignee: Mitsui-Cyanamid, Ltd., Tokyo, Japan

[21] Appl. No.: 701,636

[22] Filed: May 15, 1991

Related U.S. Application Data

[63] Continuation-in-part of Ser. No. 411,092, Sep. 22, 1989, abandoned.

[51] Int. Cl.[5] ..... D21H 17/45

[52] U.S. Cl. ..... 162/168.2; 162/168.3

[58] Field of Search ..... 162/168.2, 168.3, 164.6; 210/734

[56] References Cited

U.S. PATENT DOCUMENTS 4,759,856 7/1988 Farrar et al. ..... 210/734

*Primary Examiner*—Peter Chin

*Attorney, Agent, or Firm*—Wenderoth, Lind & Ponack

[57] ABSTRACT

Disclosed is a paper-making process for preparing a paper from a paper stock suspension, which is characterized by adding water-swellable cationic polymer particles optionally together with an acrylamide polymer to the suspension as a retention-improving agent. In the process, the stability of the retention even under high shearing force in the paper-making step is improved, the load for recovery of white water and treatment of waste water drained is reduced and the abrasion of paper-making wires is reduced.

6 Claims, 1 Drawing Sheet

PAPER-MAKING PROCESS

This application is a continuation-in-part of now abandoned application Ser. No. 07/411,092 filed on Sep. 22, 1989.

BACKGROUND OF THE INVENTION

1. Field of the Invention

The present invention relates to a paper-making process, in particular, to that having an excellent effect for improving retention of fillers and fine fibers in paper-making industry.

2. Description of the Background Art

In the paper-making industry, for manufacturing printing papers, industrial papers, etc. various fillers such as kaolin, clay, talc, titanium dioxide, calcium carbonate or urea resins are added for the purpose of improving the whiteness, opacity, printability, etc. of papers to be formed. Various means of improving the retention and fixability of fine fibrous materials have heretofore been effected for the purpose of improving the retention of the fibrous materials and the yield of the paper products and of reducing the load of treating the white water and waste water to be drained from the paper-making process.

As the retention-improving agent which has heretofore been employed for the said purpose, there are mentioned inorganic compounds such as aluminum sulfate as well as water-soluble high polymer compounds such as polyethyleneimine, polyamine, epichlorohydrin-modified polyamidepolyamine or non-ionic or ionic polyacyrlamide derivatives.

However, even though such retention-improving agent is used, a sufficient effect could not still be obtained on the following reasons:

(1) Improvement of retention of fillers and fine fibers in the paper-making step.
(2) Stability of retention under high shearing condition in the paper-making step.
(3) Stability of retention under the condition of closed water system.
(4) Reduction of the load for recovery of white water and for treatment of waste water drained.
(5) Reduction of abrasion of paper-making wires.

SUMMARY OF THE INVENTION

The object of the present invention is to overcome the said problems in the prior art and to provide a paper-making process where the retention of fillers and fine fibers in the paper stock suspension is improved and the other problems are thereby solved, the said process being characterized by employing water-swellable cationic polymer particles in place of the conventional retention-improving agent.

Specifically, the present invention provides a paper-making process for preparing a paper from a paper stock suspension, which is characterized by employing water-swellable cationic polymer particles or a mixture of water-swellable cationic polymer particles and an acrylamide based polymer.

DESCRIPTION OF THE PREFERRED EMBODIMENT

Figure 1:
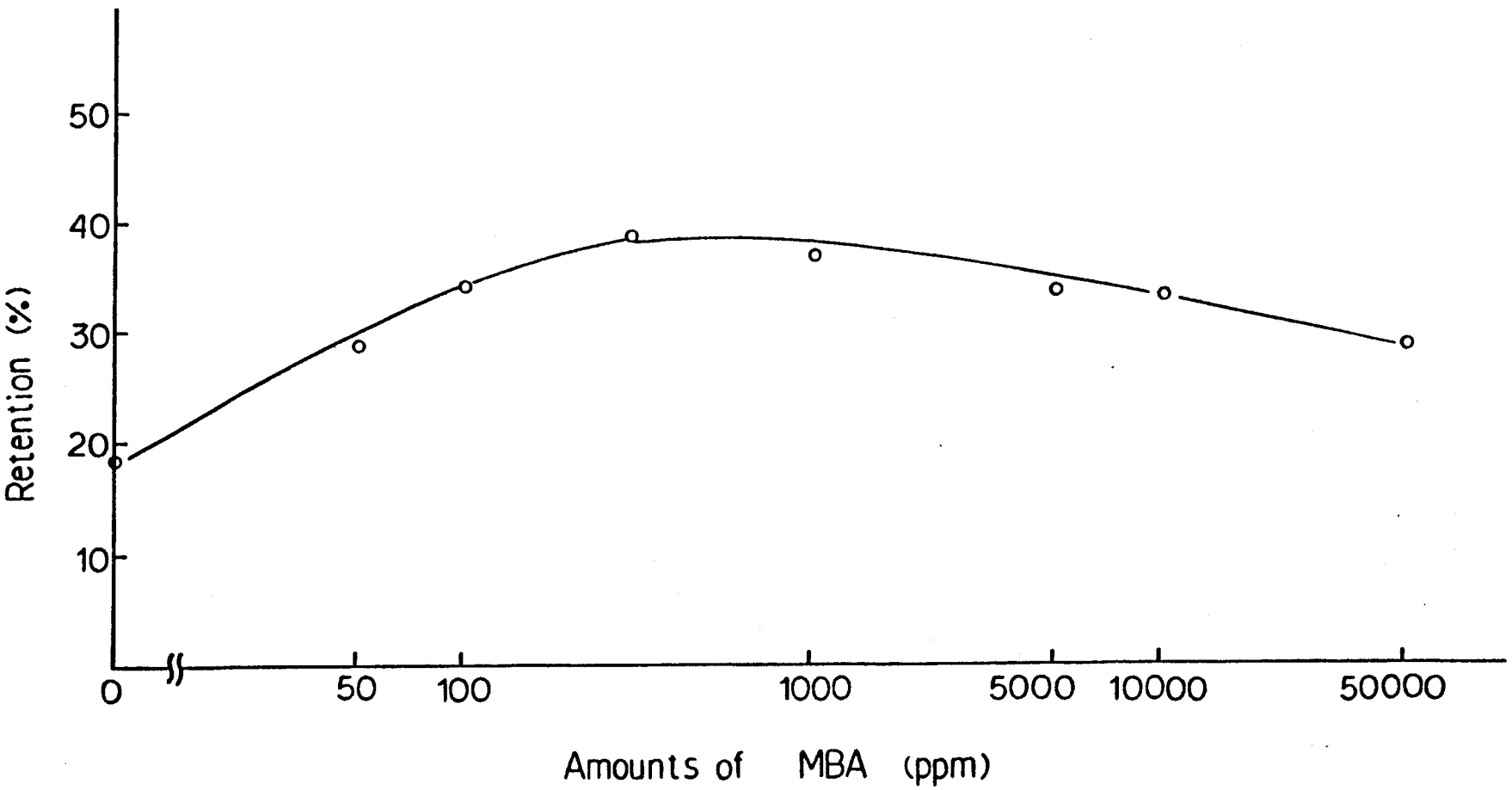
FIG. 1 is a plot of retention (%) versus amount of MBA (ppm).

In accordance with the paper-making process of the present invention, water-swellable cationic polymer particles, etc. are incorporated in the paper stock suspension, whereby the polymer particles and the fillers in the suspension interact with each other by intergranular adsorption therebetween and accordingly retention of fillers and fine fibers is thereby improved. As a result, all the unsolved problems in the prior art, such as economical effect by improvement of the retention of fillers and fine fibers, stability of such retention even under high shearing condition in the paper-making step, reduction of the load for recovery of white water and waste water drained and reduction of abrasion of paper-making wires, have been overcome by the present invention.

Now, the present invention will be explained in more detail hereunder.

The raw materials constituting the water-swellable cationic polymer particles which are used in the present invention include (A) cationic vinyl monomers, (B) non-ionic water-soluble monomers, and (C) crosslinking monomers. Examples of the respective monomers will be mentioned below.

As representative examples of cationic vinyl monomers (A), those selected from the following groups (1-A), (2-A), (3-A), (4-A) and (5-A) are mentioned.

(1-A) Quaternary nitrogen-containing (meth)acrylates (the term "(meth)acrylate" as referred to herein indicates both "acrylate" and "methacrylate")

(i) (Meth)acryloyloxyalkyl-trialkylammonium salts; such as 2-(meth)acryloyloxethyl-trimethylammonium chloride, 2-(meth)acryloyloxyethyl-trimethylammonium methosulfate, 2-(meth)acryloyloxyethyl-triethylammonium ethosulfate, 3-(meth)acryloyloxypropyl-dimethylethylammonium methosulfate, etc.

(ii) (Meth)acryloyloxyhydroxyalkyl-trialkylammonium salts; such as 3-methacryloyloxy-2-hydroxypropl-trimethylammonium chloride, 3-methacryloyloxy-2-hydroxypropylmethyl-diethylammonium chloride, 3-methacryloyloxy-2-hydroxypropyl-trimethylammonium methosulfate, etc.

(2-A) Salts of tertiary nitrogen-containing (meth)acrylates and acids (i) Salts of dialkylaminoalkyl (meth)acrylates; such as 2-dimethylaminoethyl (meth)acrylate sulfate, 2-diethyl-aminoethyl (meth)acrylate hydrochloride, etc.

(ii) Salts of dialkylaminohydroxyalkyl (meth)acrylates; such as 3-dimethylamino-2-hydroxypropyl (meth)acrylate hydrochloride, 3-diethylamino-2-hydroxypropyl (meth)acrylate sulfate, etc.

(3-A) Quaternary nitrogen-containing (meth)acrylamides (i) (Meth)acrylamidealkyl-trialkylammonium salts; such as 3-acrylamidopropyl-trimethylammonium chloride, 2-(meth)acryloylaminoethyl-trimethylammonium methosulfate, etc.

(ii) (Meth)acrylamidehydroxyalkyl-trialkylammonium salts; such as 3-(meth)acryloylamino-3-hydroxypropyl-trimethylammonium chloride, 3-(meth)acryloylaminoethyl-trimethylammonium methosulfate, etc.

(4-A) Salts of tertiary nitrogen-containing (meth)acrylamides and acids (i) Salts of dialkylaminoalkyl-(meth)acrylamides; such as 2-diethylaminoethyl-(meth)acryalmide hydrochloride, 2-diethylaminopropyl-(meth)acrylamide sulfate, etc.

(ii) Salts of dialkylaminohydroxyalkyl-(meth)acrylamides; such as 3-dimethylamino-2-hydroxypropyl-(meth)acrylamide carbonate, 3-diethylamino-2-hydroxypropyl-(meth)acrylamide sulfate, etc.

(5-A) Diallyl dialkyl ammonium chloride.

In addition, mixtures of the said compounds may also be employed in the present invention for the same purpose.

As representative examples of non-ionic water-soluble monomers (B), there are mentioned acrylamide, methacrylamide, vinyl methyl ether, vinyl ethyl ether, N-vinyl pyrrolidone and mixtures thereof.

As representative examples of crosslinking monomers (C), there are mentioned divinyl compounds such as methylene-bisacrylamide, methylene-bismethacrylamide, divinylbenzene, etc.; vinyl-methylol compounds such as methylolacrylamide, methylolmethacryl amid, etc.; vinyl-aldehyde compounds such as acrolein; vinyl compounds such as methylacrylamide-glycolate methyl ether (MAGME), etc.; as well as mixtures of the said compounds.

In the copolymer composed of the cationic vinyl monomer (A) and the crosslinking monomer (C), the proportion of the crosslinking monomer (C) in copolymerization is from 0.001 to 5% by weight, preferably from 0.005 to 1% by weight, on the basis of the weight of the total monomers. If the said proportion is less than 0.001% by weight, water-swellable particles could not be obtained on account of partial solublization, and therefore the effect of the present invention would be poor. On the other hand, if it is more than 5% by weight, the crosslinked density in the resulting copolymer would be too large and the water-swellability thereof would therefore be insufficient and, as a result, the interfacial area of the resulting polymer particles would be small and the processing effect of the present invention would disadvantageously be lowered. The water-swellability of the polymer particles for use in the present invention is from 20 to 1000 times magnification as the apparent volume and from 2.5 to 10 times magnification or so as the particle size, in pure water.

In the copolymer composed of the cationic vinyl monomer (A), the non-ionic water-soluble monomer (B) and the crosslinking monomer (C), the proportion of the cationic vinyl monomer (A) in copolymerization of the said monomers (A) and (B) is from 5 to 100% by weight, preferably from 50 to 100% by weight, and the proportion of the crosslinking monomer (C) to be employed for copolymerization of the said monomers is from 0.001 to 5% by weight, preferably from 0.005 to 1% by weight, on the basis of the weight of the total monomers.

The water-swellable cationic polymer particles for use in the present invention can be prepared by reacting the said monomers in the determined proportion by known methods. For instance, there are mentioned (a) emulsions prepared by a water-in-oil dispersion polymerization and (b) fine powders prepared by an aqueous solution polymerization or a water-in-oil suspension polymerization. Among them, the emulsions (a) containing more uniform and finer particles having a larger surface area are desired, in view of the effect and the processability thereof. The preferred particle size for the particles is from 1 to 100μ or so, before being swelled with water.

In accordance with the present invention, an acrylamide-based polymer may be employed together with the said water-swellable polymer particles. Such polymer includes various non-ionic, anionic or cationic modifed acrylamide-based polymers which are prepared by known methods. Preferably, the acrylamide-based polymer has an intrinsic viscosity [η] of from 6 to 20 or so, as obtained from the values measured in IN-$NaNO_3$ at 30° C. If the value is less than 6, the intergranular adsorptive crosslinking or a so-called coagulation effect would be insufficient. However, if the value is too large, the coagulation effect would be too high and the uniformity of the paper perpared by the process would be bad.

In the present invention, the amount of the water-swellable cationic polymer particles to be added to the paper stock suspension is from 0.005 to 0.5% by weight, preferably from 0.01 to 0.1% by weight, as the solid content of the polymer, to the solid content in the paper stock suspension.

The concentration of the said polymer which may be diluted may vary in accordance with the degree of the water-swellability thereof. For instance, when the water-swellability is 1000 times magnification, the polymer may be diluted to 0.1% or less with water and the thus diluted polymer solution may be added to the paper stock suspention.

As the means of adding the said polymer particles, it is preferred that they are diluted and swelled with water and thereafter dispersed in an aqueous system. The resulting aqueous dispersion may be added to the paper stock suspension in the paper-making process of the present invention. The water swellable cationic polymer particles of the present invention also includes the water diluted and swelled cationic polymer particles.

The amount of the acrylamide-based polymer to be employed together with the said water-swellable polymer particles is up to 0.3% by weight, preferably from 0.003 to 0.1% by weight, as the solid content of the polymer, to the solid content in the paper stock suspension. If the amount is too large, the coagulation effect would be excessively strong to cause generation of flocs, which would lower the texture (uniformity) of the paper formed by the paper-making process. As the means of adding the acrylamide polymer, in general, the polymer is diluted and dissolved in water in a concentration of from 0.1 to 1% or so, and the thus diluted polymer solution is added to the paper stock suspension after addition of the above-mentioned water-swellable cationic polymer particles thereto.

Where the amounts of the polymers are outside the range as specifically defined above, the intended object of the present invention could not be attained.

The present invention will be illustrated in more detail by way of the following examples, which, however, are not intended to restrict the scope of the present invention. Unless otherwise specifically indicated, all "%" in the examples are "% by weight".

(1) Preparation of Polymer A 820 g of a water solution containing 309.6 g of 2-methacryloyloxyethyl-trimethylammonium chloride (MTA) and 0.06 g of water-soluble azo catalyst (V-50) were emulsified in a homogenizer in 240 g paraffin oil (boiling point range: 200°-230° C.) containing 15 g non-ionic surface active agent with an HLB of 4.2 (sorbitan monoleate). The resulting emulsion was transferred to a 4-necked flask and was polymerized at a polymerization temperature of 60° C. while being deaerated with $N_2$ gas. The polymerization was complete in about 4 hours.

After completion of polymerization, the polymerized product was added with 25 g of a nonionic surface active agent with an HLB of 12.3 (polyoxyethylene lauryl ether), whereby there was obtained a stable emulsion with an average particle diameter of 5.1 μm.

In the above preparation of Polymer A, N,N'-methylene bis acrylamide (MBA) is added with MTA as illustrated in Table 2.

(2) Preparation of Polymer B

Stable emulsion having an average particle diameter of 3.6 μm was obtained by the same method of Polymer A except using 185.8 g of 2-methacryloyloxyethyltrimethylammonium chloride and 123.8 g of acrylamide (AM) as monomers.

Necessary amounts of MBA were added with the above monomers as illustrated in Table 2.

(3) Preparation of Polymer C, D, E

Acrylamide base polymers C,D,E were prepared by an aqueous solution polymerization method.

These polymers are illustrated in Table 1.

(4) Retention of Calcium Carbonate

The water-swellable cationic polymer particles were dispersed and swelled in water in a proportion of 0.1% as the solid content thereof; and the acrylamide-based polymers were also dissolved in water in a concentration of 0.1% as the solid content thereof. The aqueous dispersion and solution were thus subjected to the experiment.

On the other hand, 0.5% of aluminum sulfate, 0.5% of cationic starch, 0.2% of alkylketene dimer of neutral size emulsion and 20% of heavy calcium carbonate were added to 0.8%-diluted LBKP (degree of beating: 430 ml C.S.F.) to prepare a pulp slurry sample. (The "%" is "dry weight percentage" to pulp.)

To the thus prepared pulp slurry sample was added the above-mentioned retention-improving agent, that is the water-swellable cationic polymer particles were first added and fully stirred and thereafter the acrylamide-based polymers were added.

For the calcium carbonate-retention test, a Britt-type Dynamic Drainage Tester (with 140-mesh screen) was used. The rotation speed of the tester was 2000 rpm. The results obtained are shown in Table 3 below.

As is obvious from the results in Table 3, the retention of calcium carbonate was higher in Example Nos. 8–12 than in Comparative Example Nos. 1–5 where the acrylamide-based polymer (D) or (E) was used singly.

In addition, the retention of heavy calcium carbonate was higher in Example Nos. 15–21 where the water-swellable cationic polymer particles were used together with the acrylamide-based polymer than that in Comparative Example Nos. 1–5.

Furthermore, the retention of calcium carbonate was superior in the area where the amount of crosslinkable monomer was 100–10,000 ppm, preferably 300–1,000 ppm, as illustrated in FIG. 1 (Experiment No. 6–13 in Table 3).

(5) Retention of Fine Fibers of Waste Board Paper

The same water-swellable cationic polymer particles and acrylamide-based polymer were used and subjected to the experiment. In the same manner as in the example of calcium carbonate, the particles were dispersed or dissolved in water.

On the other hand, a pulp prepared by beating used corrugated board paper and diluted to 0.8% was added with 1% aluminum sulfate to give the pulp slurry sample.

The given retention-improving agent was added to the said pulp slurry sample, whereupon the water-swellable cationic polymer particles were first added and fully stirred and then the acrylamide-based polymers were added thereto. The retention of fine fibers was examined by the use of Britt-type Dynamic Drainage Tester at a rotation speed of 750 rpm. For comparison, the same process as above was repeated except that only the acrylamide-based polymers were added to the pulp slurry sample.

Measurement of the fine fibers was effected in accordance with TAPPI Standard T281pm-79. The conditions and the results obtained are shown in Table 4.

As is obvious from the results in Table 4, the retention of fine fibers was higher in Examples No. 34–41 than in Comparative Examples 28–32.

In accordance with the present invention, the retention effect of the fillers and fine fibers in the paper stock suspension is far superior to that of the prior art process, and accordingly, the stability of the retention under high shearing force in the paper-making step is improved, the load for recovery of white water and treatment of waste water drained is reduced in the paper-making process of the present invention. The present invention is therefore industrially excellent in view of the said advantages.

TABLE 1

| | Code | Constituents |
|---|---|---|
| Water-Swellable Cationic Polymer Particles | A | Crosslinked homopolymer of 2-methacryloyloxyethyl-trimethylammonium chloride |
| | B | Crosslinked polymer of 2-methacryloyloxyethyl-trimethylammonium chloride/acrylamide (=60/40, by weight) |
| Acrylamide Polymer Particles | C | Acrylamide homopolymer [η]= 13 (30° C., 1N—$NaNO_3$) |
| | D | Hydrolyzed Polyacrylamide [η]= 14.5 (30° C., 1N—$NaNO_3$) Anionicity 17 mol % |
| | E | Copolymer of acrylamide/2-methacryloyloxyethyltrimethyl-ammonium chloride (=75/25, by weight) [η]= 13 (30° C., 1N—$NaNO_3$) |

TABLE 2

| Water-swellable cationic polymers | | | |
|---|---|---|---|
| No. | Polymer contents | Amounts of crosslinkable monomer (MBA) (ppm) | |
| A-1 | MTA | 0 | [η]= 7.8 |
| A-2 | MTA + MBA | 50 | (30° C., |
| A-3 | " | 100 | 1N—$NaNO_3$) |
| A-4 | " | 300 | |

TABLE 2-continued

| | Water-swellable cationic polymers | | |
|---|---|---|---|
| No. | Polymer contents | Amounts of crosslinkable monomer (MBA) (ppm) | |
| A-5 | " | 1,000 | |
| A-6 | " | 5,000 | |
| A-7 | " | 10,000 | |
| A-8 | " | 50,000 | |
| B-1 | MTA + AM | 0 | [η]= 9.5 |
| B-2 | MTA + AM + MBA | 50 | (30° C., |
| B-3 | " | 100 | 1N—$NaNO_3$) |
| B-4 | " | 300 | |
| B-5 | " | 1,000 | |

MTA: 2-Methacryloyloxyethyl-trimethyl ammonium chloride
MBA: N,N'-methylene bis acrylamide
AM: Acrylamide proved, the load for recovery of white water and treatment of waste water drained is reduced and the abrasion of paper-making wires is reduced in the paper-making process of the present invention. The present invention is therefore industrially excellent in view of the said advantages.

What is claimed is:

1. A paper-making process for preparing a paper from paper stock suspension, which comprises adding to said suspension either water-swellable cationic polymer particles or water-swellable cationic polymer particles together with acrylamide-based polymer, wherein the water-swellable cationic polymer is a copolymer composed of either a cationic vinyl monomer selected from the group consisting of quaternary nitrogen-containing (meth)acrylates, salts of tertiary nitrogen-containing (meth)acrylates with acids, quaternary nitrogen-containing (meth)acrylamides, salts of tertiary nitrogen-containing (meth)acrylamides with acids and diethyldialkyl ammonium chloride, and a crosslinkable monomer

TABLE 3

| | | | Retention of Calcium Carbonate | | | | | |
|---|---|---|---|---|---|---|---|---|
| | No. | Water-swellable cationic polymer | Amounts of MBA | Amounts Added (%/Pulp) | Acrylamide-based polymer | Amounts Added (%/Pulp) | 1 pass Retention (%) of Calcium Carbonate | Uniformity |
| Comparative Example | 1 | — | — | — | D | 0.01 | 12.0 | ○ |
| " | 2 | — | — | — | D | 0.03 | 24.9 | Δ |
| " | 3 | — | — | — | D | 0.10 | 32.0 | x |
| " | 4 | — | — | — | D | 0.15 | 28.7 | x |
| " | 5 | — | — | — | E | 0.10 | 29.5 | Δ |
| " | 6 | A | 0 | 0.10 | — | — | 18.5 | Δ |
| " | 7 | " | 50 | 0.10 | — | — | 28.6 | ○ |
| Example | 8 | " | 100 | 0.10 | — | — | 34.0 | ○ |
| " | 9 | " | 300 | 0.10 | — | — | 38.5 | ◎ |
| " | 10 | " | 1,000 | 0.10 | — | — | 36.6 | ◎ |
| " | 11 | " | 5,000 | 0.10 | — | — | 33.5 | ○ |
| " | 12 | " | 10,000 | 0.10 | — | — | 33.0 | ○ |
| Comparative Example | 13 | " | 50,000 | 0.10 | — | — | 28.5 | ○ |
| Example | 14 | " | 300 | 0.15 | — | — | 41.5 | ◎ |
| " | 15 | " | " | 0.10 | D | 0.01 | 43.5 | ○ |
| " | 16 | " | " | 0.10 | D | 0.02 | 45.3 | ○ |
| " | 17 | " | " | 0.10 | D | 0.03 | 47.5 | ○ |
| " | 18 | " | " | 0.05 | D | 0.03 | 44.5 | ○ |
| " | 19 | " | " | 0.15 | D | 0.03 | 50.1 | ○ |
| " | 20 | " | " | 0.10 | C | 0.03 | 45.2 | ○ |
| " | 21 | " | " | 0.10 | E | 0.03 | 48.5 | ○ |
| Comparative Example | 22 | B | 0 | 0.10 | — | — | 16.5 | Δ |
| " | 23 | " | 50 | 0.10 | — | — | 25.0 | ○ |
| Example | 24 | " | 100 | 0.10 | — | — | 34.5 | ○ |
| " | 25 | " | 300 | 0.10 | — | — | 35.5 | ○ |
| " | 26 | " | 1,000 | 0.10 | — | — | 35.0 | ○ |
| " | 27 | " | 4,300 | 0.10 | D | 0.03 | 44.9 | ○ |

TABLE 4

| | | Retention of Fine Fibers of Waste Board Paper (Corrugated Board Paper) | | | | | | |
|---|---|---|---|---|---|---|---|---|
| | No. | Water-swellable cationic polymer | Amounts of MBA | Amounts added (%/Pulp) | Acrylamide-based polymer | Amounts added (%/Pulp) | Retention of Fine Fibers | Uniformity |
| Comparative Example | 28 | — | — | — | E | 0.01 | 45.1 | ○ |
| " | 29 | — | — | — | E | 0.03 | 52.3 | Δ |
| " | 30 | — | — | — | E | 0.05 | 60.1 | Δ |
| " | 31 | — | — | — | E | 0.10 | 61.3 | x |
| " | 32 | — | — | — | D | 0.10 | 60.5 | x |
| " | 33 | A | 50 | 0.10 | — | — | 53.5 | Δ |
| Example | 34 | " | 100 | 0.10 | — | — | 62.8 | ○ |
| " | 35 | " | 300 | 0.15 | — | — | 69.5 | ○ |
| " | 36 | " | " | 0.10 | C | 0.01 | 68.9 | ○ |
| " | 37 | " | " | 0.10 | C | 0.02 | 85.1 | ◎ |
| " | 38 | " | " | 0.10 | C | 0.03 | 92.3 | ○ |
| " | 39 | " | " | 0.10 | D | 0.03 | 91.5 | ○ |
| " | 40 | " | " | 0.15 | D | 0.03 | 93.5 | ○ |
| " | 41 | " | 10,000 | 0.15 | D | 0.02 | 89.5 | ◎ |

In accordance with the present invention, the retention effect of the fillers and fine fibers in the paper stock suspension is far superior to that of the prior art process, and accordingly, the stability of the retention under high shearing force in the paper-making step is imselected from the group consisting of methylene bisacrylamide, methylene bismethacrylamide, divinyl benzene, acrolein and methacrylamide-glycolate methyl ether, or a copolymer composed of said cationic vinyl monomer, a non-ionic water-soluble monomer copolymerizable with the said vinyl monomer, selected from the group consisting of acrylamide, methacrylamide, vinyl methyl ether, vinyl ethyl ether, N-vinyl pyrrolidone; N,N-dialkyl(meth)acrylamide, and N-vinylmethacetamide and said crosslinkable monomer and said crosslinkable monomer is present at 100 to 10,000 ppm based on the total weight of the monomers and forming paper from said stock suspension.

2. The paper-making process as claimed in claim 1, in which the amount of the water-swellable cationic polymer particles to be added to the paper stock suspension is from 0.005 to 0.5% by weight as the solid polymer content to the total solid content in the suspension.

3. The paper-making process as claimed in claim 2, in which the amount of the water-swellable cationic polymer particles to be added to the paper stock suspension is from 0.01 to 0.1% by weight as the solid polymer content to the total solid content in the suspension.

4. The paper-making process as claimed in claim 1, in which the amount of the acrylamide-based polymer to be added to the paper stock suspension is up to 0.3% by weight as the solid polymer content to the total solid content in the suspension.

5. The paper-making process as claimed in claim 4, in which the amount of the acrylamide-based polymer to be added to the paper stock suspension is from 0.003 to 0.1% by weight as the solid polymer content to the total solid content in the suspension.

6. A paper-making process for preparing a paper from paper stock suspension, which comprises adding to said suspension either water-swellable cationic polymer particles or water-swellable cationic polymer particles together with acrylamide-based polymer, wherein the water-swellable cationic polymer is a copolymer composed of either a cationic vinyl monomer selected from the group consisting of quaterary nitrogen-containing (meth)acrylates, salts of tertiary nitrogen-containing (meth)acrylates with acids, quaternary nitrogen-containing (meth)acrylamides, salts of tertiary nitrogen-containing (meth)acrylamides with acids and diethyldialkyl ammonium chloride and a crosslinkable monomer selected from the group consisting of methylene bisacrylamide, methylene bismethacrylamide, divinyl benzene, acrolein and methacrylamide-glycolate methyl ether or a copolymer composed of said cationic vinyl monomer, a non-ionic water-soluble monomer copolymerizable with the said vinyl monomer, selected from the group consisting of acrylamide, methacrylamide, vinyl methyl ether, vinyl ethyl ether, N-vinyl pyrrolidone; N,N-dialkyl(meth)acrylamide, and N-vinylmethacetamide and said crosslinkable monomer, and said crosslinkable monomer is present at 300~1,000 ppm based on the total weight of the monomers, and forming paper from said stock suspension.

* * * * *